US007549723B2

(12) United States Patent
Mihara et al.

(10) Patent No.: US 7,549,723 B2
(45) Date of Patent: Jun. 23, 2009

(54) RECORDING APPARATUS

(75) Inventors: Akira Mihara, Kanagawa (JP); Toru Nishida, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 459 days.

(21) Appl. No.: 11/197,975

(22) Filed: Aug. 5, 2005

(65) Prior Publication Data

US 2006/0176352 A1 Aug. 10, 2006

(30) Foreign Application Priority Data

Feb. 4, 2005 (JP) ..... 2005-029302

(51) Int. Cl.
*B41J 2/165* (2006.01)
*G03G 15/00* (2006.01)
*B41J 2/01* (2006.01)

(52) U.S. Cl. ..... 347/23; 271/182; 271/3.03; 271/314; 271/303; 355/319; 355/322; 347/104

(58) Field of Classification Search ..... 347/23
See application file for complete search history.

(56) References Cited

U.S. PATENT DOCUMENTS 5,136,343 A * 8/1992 Braswell ..... 399/403
5,428,379 A * 6/1995 Kaneko et al. ..... 347/23
5,549,291 A * 8/1996 Devito ..... 271/182
6,250,754 B1 * 6/2001 Bortolotti ..... 347/104
2003/0128253 A1 * 7/2003 Kitahara et al. ..... 347/42
2003/0174186 A1 * 9/2003 Valero et al. ..... 347/35

FOREIGN PATENT DOCUMENTS

JP 57-141656 9/1982
JP 58-181064 12/1983
JP 2003-154643 5/2003

* cited by examiner

*Primary Examiner*—Stephen D Meier
*Assistant Examiner*—Alexander C Witkowski
(74) *Attorney, Agent, or Firm*—Fildes & Outland, P.C.

(57) ABSTRACT

A recording apparatus includes: a recording unit which records an image by ejecting ink to a conveyed recording medium; a conveying unit which returns the recording medium, on which the image has been recorded by the recording unit, in order toward an upstream side in a conveying direction; and a reversal unit which is provided at a downstream side of the conveying unit in a returning direction, the reversal unit including a plurality of holding units which respectively suck and hold a recording medium that has been returned by the conveying unit, reverse the recording medium, and send the recording medium to the recording unit.

22 Claims, 13 Drawing Sheets

RECORDING APPARATUS

CROSS-REFERENCE TO RELATED APPLICATION

This application claims priority under 35 USC 119 from Japanese Patent Application No. 2005-029302, the disclosure of which is incorporated by reference herein.

BACKGROUND OF THE INVENTION

1. Field of the Invention

The invention relates to a recording apparatus provided with a reversal mechanism which reverses a recording medium in performing double-sided recording.

2. Description of the Related Art

When an image is recorded on both sides of a recording medium in a recording apparatus which performs image recording, after the image recording is performed to one side of the recording medium by a recording unit, it is necessary that the recording medium is reversed by a reversal mechanism and conveyed to the recording unit again.

An example of a recording apparatus provided with a reversal mechanism which reverses a recording medium is disclosed in Japanese Patent Laid-Open (JP-A) No. 57-141656. In the recording apparatus disclosed in JP-A No. 57-141656, a recording medium on which an image has been recorded by a recording unit is conveyed to the recording unit again through a switch-back path.

However, in the recording apparatus disclosed in JP-A No. 57-141656, because the switch-back path is the same as a conveying path for the next recording medium conveyed from a sheet-feed tray, it is necessary to temporarily stop the next recording medium conveyed from the sheet-feed tray during switching back of the recording medium in the switch-back path, which decreases speed of the image recording.

JP-A No. 58-181064 discloses a configuration, in which a recording medium on which image recording has been performed is stopped once and reversed by a return unit and then the recording medium is conveyed to the recording unit again.

However, in the configuration disclosed in JP-A No. 58-181064, although drying time for the recording medium can be secured since the recording medium on which image recording has been preformed is stopped once by the return unit, image recording is delayed by the amount of time that the recording medium is stopped in the return unit.

SUMMARY OF THE INVENTION

The present invention has been made in view of the above circumstances and provides a recording apparatus which can maintain the high-speed image recording while securing drying time for the recording medium.

A recording apparatus of the invention includes a recording unit which records an image by ejecting ink to a conveyed recording medium; a conveying unit which returns the recording medium, on which the image has been recorded by the recording unit, in order toward an upstream side in a conveying direction; and a reversal unit which is provided at a downstream side of the conveying unit in a returning direction, the reversal unit including plural holding units which respectively suck and hold a recording medium that has been returned by the conveying unit, reverse the recording medium, and send the recording medium to the recording unit.

In the recording apparatus of the invention, the recording unit ejects the ink to the conveyed recording medium to record the image. Then, the conveying unit returns the recording medium to which the image recording has been performed to the upstream side in the conveying direction not by reversing the recording medium but by sending the recording medium in order. The plural holding units in the reversal unit, which are provided on the downstream side of the conveying unit in the returning direction, suck and hold the recording mediums returned by the conveying unit, and the recording mediums are reversed and sent to the recording unit.

BRIEF DESCRIPTION OF THE DRAWINGS

Preferred embodiments of the present invention will be described in detail based on the following figures, wherein.

DETAILED DESCRIPTION OF THE INVENTION

Referring to FIGS. 1 to 7, an inkjet printer (recording apparatus) according to an embodiment of the present invention will be described below.

Figure 1:
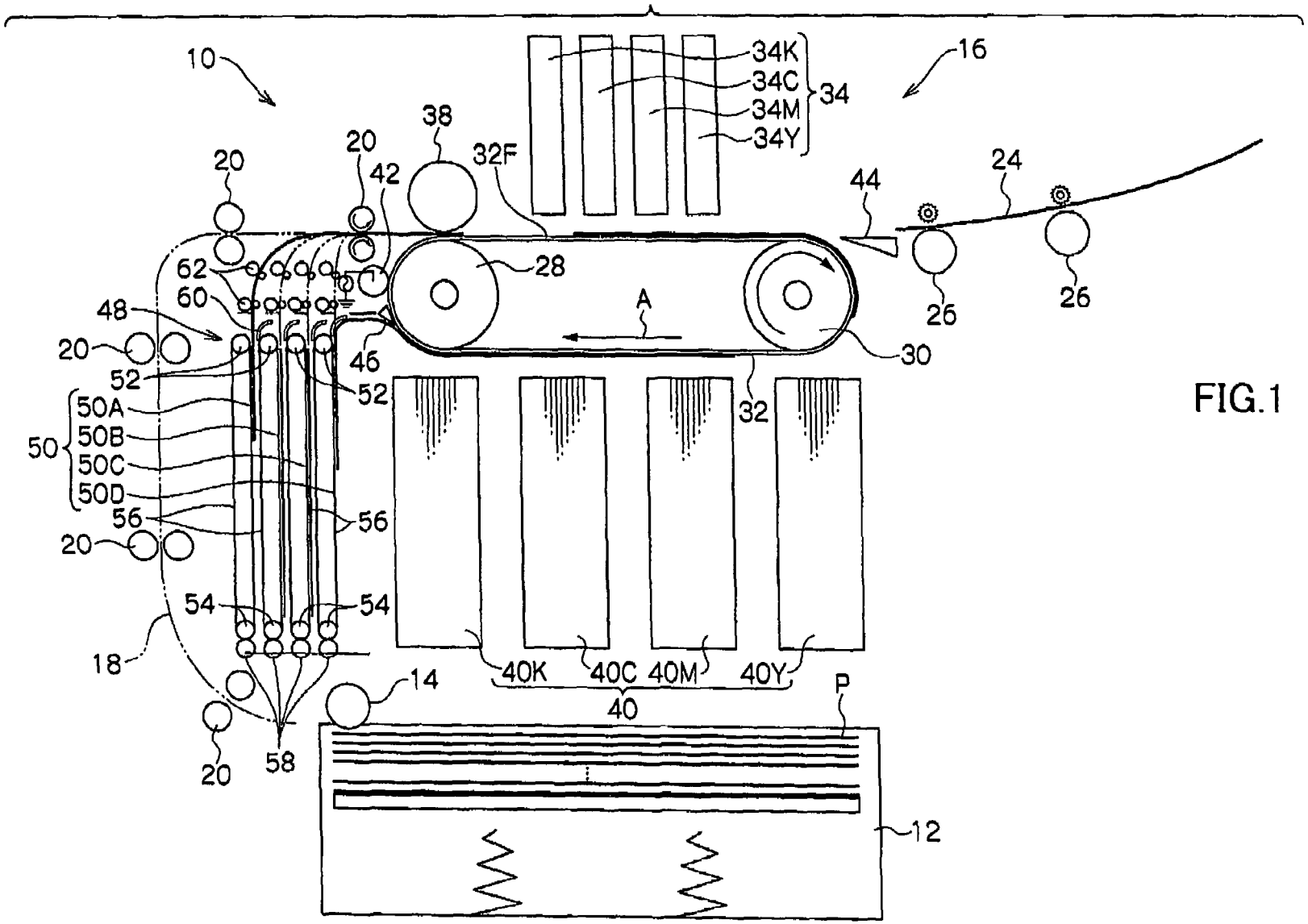
FIG. 1 shows an overall configuration of an inkjet printer according to an embodiment of the invention.

First an overall configuration of the inkjet printer will schematically be described. FIG. 1 shows the overall configuration of the inkjet printer according to the embodiment.

As shown in FIG. 1, an inkjet printer 10 includes a sheet-feed cassette 12 in which sheets (recording mediums) P are accommodated. A feed roller 14 is arranged in an upper portion on a leading end side (left end side of FIG. 1) of the sheet-feed cassette 12. The feed roller 14 takes out the sheet P from the inside of the sheet-feed cassette 12 while pressing an upper surface on the leading end side of the sheet P.

There is also provided a sheet-feed conveying path 18 which extends from the leading end portion of the sheet-feed cassette 12 to a recording unit 16 which records an image on the recording surface of the sheet P. Plural pairs of sheet-feed conveying rollers 20 are provided at the sheet-feed conveying path 18. The pair of sheet-feed conveying rollers 20 conveys the sheet P to the recording unit 16 while nipping the sheet P.

Further, there is provided a sheet-discharge, conveying path 24 which extends from the upper portion of the recording unit 16 to a sheet-discharge tray (not shown). The sheet-discharge tray accommodates the sheet P in which the image is recorded. Plural pairs of sheet-discharge conveying roller and star gear 26 are provided in the sheet-discharge conveying path 24. The pair of sheet-discharge conveying roller and star gear 26 conveys the sheet P to the sheet-discharge tray while nipping the sheet P.

The recording unit 16 includes inkjet recording heads 34. The inkjet recording heads 34 have a wide effective recording area larger than a width (length in a direction orthogonal to the conveying direction) of the sheet P. Four inkjet recording heads 34K, 34C, 34M, and 34Y which correspond to four colors of black (K), cyan (C), magenta (M), and yellow (Y) are respectively arranged along the sheet conveying direction, which enables full-color printing (image recording).

A recording head control unit (not shown) is connected to each of the inkjet recording heads 34K, 34C, 34M, and 34Y. The recording head control unit determines ink droplet ejection timing and nozzles used according to image information, and the recording head control unit inputs drive signals to each of the inkjet recording heads 34K, 34C, 34M, and 34Y to control the inkjet recording heads 34.

Ink tanks 40 (40K, 40C, 40M, and 40Y) which supply the ink to each of the inkjet recording heads 34K, 34C, 34M, and 34Y are provided below the inkjet recording heads 34. The ink tanks 40 and the inkjet recording heads 34 are connected to each other with tubes (not shown), and the ink is supplied to the inkjet recording heads 34 by pumps (not shown).

An endless conveying belt (conveying unit) 32 is arranged between the ink tank 40 and the inkjet recording head 34. The conveying belt 32 is entrained about a drive roller 30 and a driven roller 28. The drive roller 30 is positioned at the downstream side in the sheet conveying direction, and the driven roller 28 is positioned at the upstream side. The conveying belt 32 is driven (rotated) in a circular manner in the direction of an arrow A in FIG. 1 (clockwise direction).

An opposed roller 38 is positioned at the upper side of the driven roller 28. The opposed roller 38 is in contact with the surface side of the conveying belt 32 while sliding on the conveying belt 32. A charging roller 42 which charges the surface of the conveying belt 32 is provided in the horizontal direction of the driven roller 28 adjacent to the driven roller 28.

The conveying belt 32 charged by the charging roller 42 electrostatically sucks the sheet P to convey the sheet P to an ejecting area 32F of the inkjet recording head 34. Then, according to the image information, the ink droplets are adhered to the sheet P from the inkjet recording head 34 while the sheet P faces the inkjet recording head 34. The conveying belt 32 can convey two sheets P at one time while sucking the two sheets P.

In the case of single-sided printing, the sheet P to which the ink has been adhered is peeled off from the conveying belt 32 by a peeling pawl 44 arranged between the conveying belt 32 and the sheet-discharge conveying path 24, and then the sheet P is introduced to the sheet-discharge conveying path 24. In the case of the double-sided printing, the peeling pawl 44 does not act, but rather the sheet P is returned toward the upstream side in the conveying direction while electrostatically sucked by the charged conveying belt 32.

A reversal unit 48 is provided on the downstream side of the conveying belt 32 in the returning direction. The reversal unit 48 holds the plural sheets P by sucking a surface opposite to the recording surface of the sheet P (i.e., a non-recording surface) returned by the conveying belt 32, and the reversal unit 48 performs the switch back (reversal) of the sheet P and sends the sheet P to the conveying belt 32.

A peeling pawl 46 is arranged between the reversal unit 48 and the conveying belt 32. According to the peeling pawl 4G, the sheet P electrostatically sucked by the conveying belt 32 is peeled off and introduced to the reversal unit 48.

The reversal unit 48 includes four holding units 50 which respectively hold the sheets P. The holding units 50 can hold four sheets P which is two times the number of sheets P, i.e., two sheets, which the conveying belt 32 can convey without overlapping the sheets P. The holding unit 50 includes a first holding unit 50A, a second holding unit 50B, a third holding unit 50C, and a fourth holding unit 50D in this order from the downstream side in the returning direction. The holding units 50A, 50B, 50C, and 50D are vertically arranged in parallel with one another.

Each of the holding units 50A, 50B, 50C, and 50D includes an endless suction belt 56 which is entrained about a drive roller 52 and a driven roller 54. The drive roller 52 is positioned at the upper portion and the driven roller 54 is positioned at the lower portion. A charging roller 58 which charges the surface of the suction belt 56 is provided beneath the driven roller 54. The suction belt 56 charged by the charging roller 58 electrostatically sucks and holds the sheet P. The suction belt 56 can take in the sheet P by normal rotation of the drive roller 52, and the suction belt 56 can deliver the sheet P upward by reverse rotation of the drive roller 52.

Figure 2:
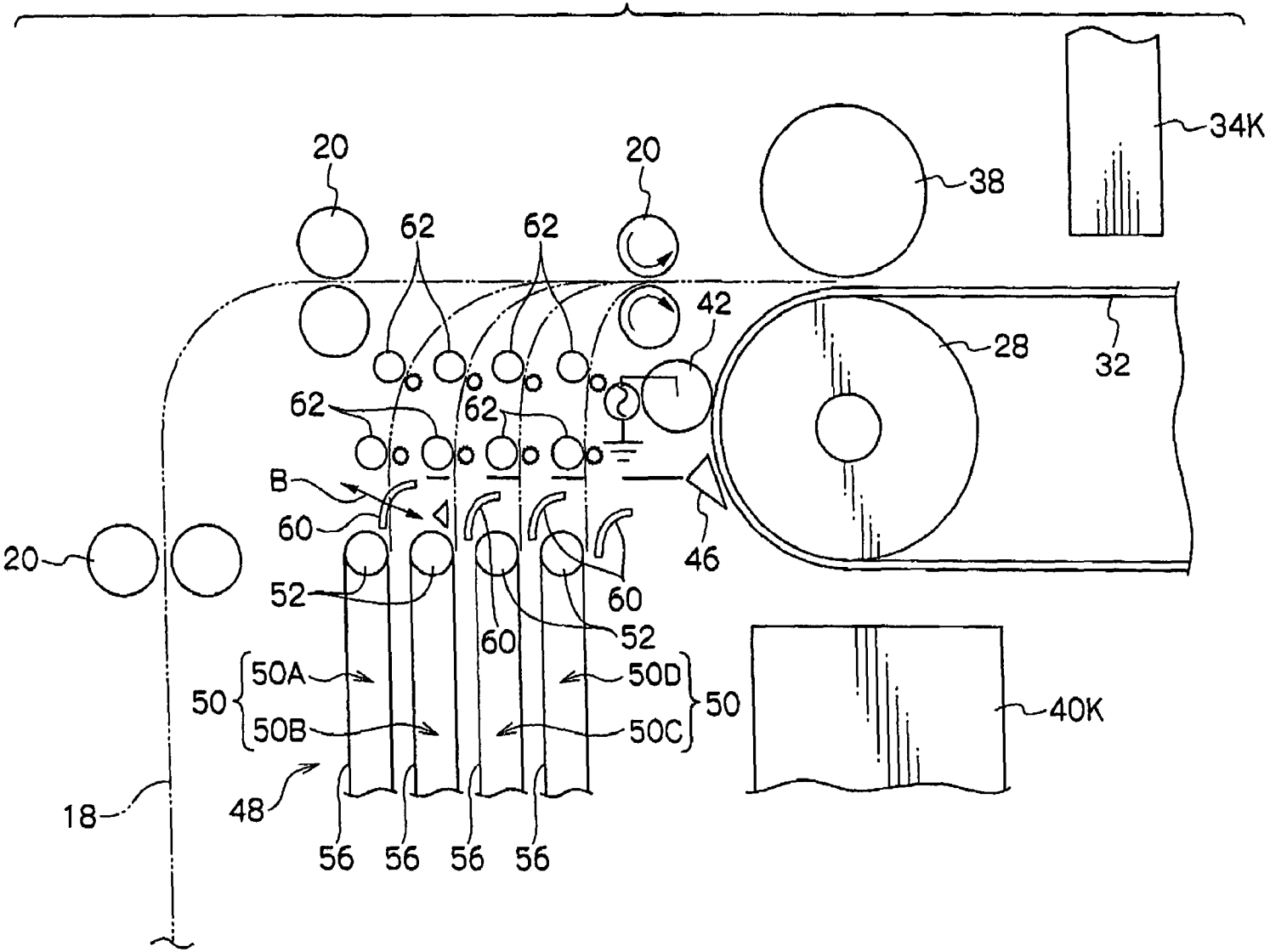
FIG. 2 is an enlarged view showing a reversal unit according to the embodiment.

A gate 60 is provided in each gateway of the holding units 50A, 50B, 50C, and 50D above the drive roller 52. The gate 60 guides the sheet P, when the sheet P is taken into the holding unit 50, and when the sheet P is sent from the holding unit 50 into the sheet-feed conveying path 18. As shown in FIG. 2, the gate 60 is adapted to be movable in an oblique direction (B direction in FIG. 2). The gate 60 is moved outward to guide the sheet P by an inside surface thereof when the sheet P is taken into the holding unit 50, and the gate 60 is moved inward to guide the sheet P by an outside surface thereof when the sheet P is sent into the sheet-feed conveying path 18. A pair of conveying roller and star gear 62 is provided above the gate 60. The pair of conveying roller and star gear 62 conveys the sheet P from each of the holding units 50A, 50B, 50C, and 50D while nipping the sheet P to send the sheet P into the sheet-feed conveying path 18.

It is possible to dispose the reversal unit 48 below the conveying belt 32 by rotating the reversal unit 48 by 90 degrees and making the side at which the gates 60 are provided the left side, in order to reduce the width of the recording apparatus.

Thus, in the case of single-sided printing, the sheet P is taken out from the sheet-feed cassette 12 by the feed roller 14, and the sheet P is conveyed by the plural pairs of sheet-feed conveying rollers 20 through the sheet-feed conveying path 18. Then, the sheet P is nipped between the opposed roller 38 and the conveying belt 32, and the sheet P is sucked by the charged conveying belt 32 and sent to the recording unit 16. The inkjet recording head 34 performs the image recording by ejecting the ink onto the sheet P sent to the recording unit 16, the sheet P on which the image recording has been performed is peeled off from the conveying belt 32 by the peeling pawl 44, the sheet P is conveyed through the sheet-discharge conveying path 24 by the plural pairs of sheet-discharge conveying roller and star gear, and then the sheet p is discharged to the sheet-discharge tray.

In the case of double-sided printing, the peeling pawl 44 does not act, but instead the sheet P on which single-sided printing has been performed is returned from the drive roller 30 while being sucked onto the conveying belt 32. Then, the sheet P is peeled off from the conveying belt 32 by the peeling pawl 46, the sheet P is guided to the inside surface of the gate 60 which has moved outward, and the sheet P is sent to the holding unit 50. At this time, the sheet P is sucked onto the charged suction belt 56 of the holding unit 50. The switch back of the sucked sheet P is performed by the reverse rotation of the suction belt 56, and the sheet P is guided to the outside surface of the gate 60 which has moved inward. Then, the sheet P is conveyed while nipped between the pair of conveying rollers 62, the sheet P is sent to the conveying belt 32 through the sheet-feed conveying roller 20 again, and the printing is performed on the sheet P by the inkjet recording head 34. Thus, the printing is performed in the above manner.

Next, referring to a flowchart of FIG. 3, a printing procedure will be described.

As described above, the printing procedure is one in which double-sided printing is performed under the conditions that the conveying belt can convey two sheets and the reversal unit can hold four sheets which is two times the number of the two sheets.

When the printing is started, in Step 102, it is determined whether or not double-sided printing is performed. When double-sided printing is not performed ("No" in Step 102), normal single-sided printing is performed in Step 104, and the printing is finished. When double-sided printing is performed ("Yes" in Step 102), in Step 106, it is determined whether or not the number of printed pages is larger than eight (four sheets).

The order of the pages printed in the following procedure is different from the page order in the printed document. Particularly, a page expressed by "n-th page" does not indicate the page order in the document, but indicates the order in which the page to be printed.

When the number of printed pages is not more than eight ("No" in Step 106), normal double-sided printing is performed in Step 108. In the normal double-sided printing, the switch back is immediately performed with respect to the sheet P taken into the holding unit 50, and the sheet P is sent to the recording unit 16 via the sheet-feed conveying path 18. When the normal double-sided printing is performed, the process is finished.

When the number of printed pages is more than eight ("Yes" in Step 106), special double-sided printing is performed in Step 110.

In the special double-sided printing, the printing is performed on the sheet surface in Step 110. When the first-page printing is completed, a count of a page counter is incremented by one. Then, in Step 112, it is determined whether or not a value of the page counter exceeds four after the printing. When the page counter does not exceed four ("No" in Step 112), the procedure returns to Step 110 to perform the sheet surface printing. The sheet surface printing is repeatedly conducted until the value of the page counter exceeds four. When the value of the page counter exceeds four ("Yes" in Step 112), backside printing is performed in Step 114.

Then, in Step 116, it is determined whether or not the value of the page counter is lower than eight after the backside printing is performed. When the value of the page counter is lower than eight ("Yes" in Step 116), in Step 118, it is determined whether or not a remaining page exists (the number of remaining pages is lower than one). When a remaining page exists ("No" in Step 118), the procedure returns to Step 114 to perform backside printing. The backside printing is performed until a remaining page does not exist. When a remaining page does not exist ("Yes" in Step 118), the printing is finished.

When the value of the page counter is not lower than eight after the printing is performed in Step S116 ("No" in Step 116), in Step 122, it is determined whether or not a remaining page exists (the number of remaining pages is lower than one). When a remaining page does not exist ("Yes" in Step 122), the printing is finished.

When a remaining page exists ("No" in Step 122), the value of the page counter is returned to zero in Step 124, and the procedure returns to Step 110 to repeat the same processes.

Next, referring to FIGS. 4A to 4G, the specific procedure of Step 110 to Step 124 will be described.

In the embodiment, the four sheets P are respectively held at the first holding unit 50A to the fourth holding unit 50D. Therefore, the surface printing is continuously performed on the four sheets P.

Figure 4A:
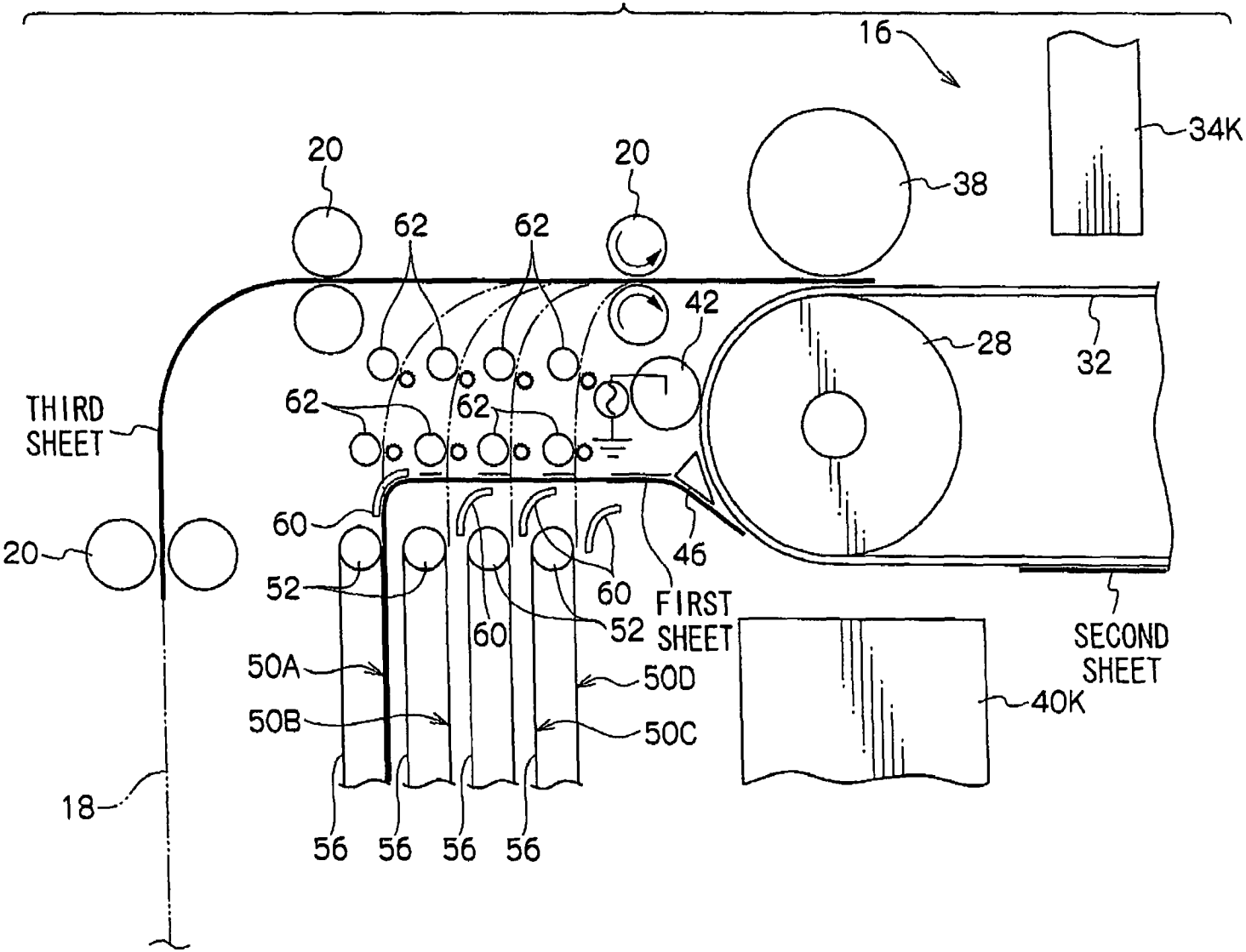
FIG. 4A shows a position of each sheet when a first sheet is delivered into a holding unit in the printing procedure according to the embodiment.

Specifically, firstly, the sheet feeding of the first sheet P is started, and the surface printing is performed on the first sheet in the recording unit 16. Namely, the first-sheet printing is performed. Then, as shown in FIG. 4A, the first sheet on which the surface printing has been performed is conveyed on the conveying belt 32, and the first sheet is sent into the first holding unit 50A. When the first sheet is sent into the first holding unit 50A, the surface printing (second-page printing) on the second sheet has been completed, and the second sheet is being conveyed on the conveying belt 32. The sheet feeding of the third sheet is started.

Figure 4B:
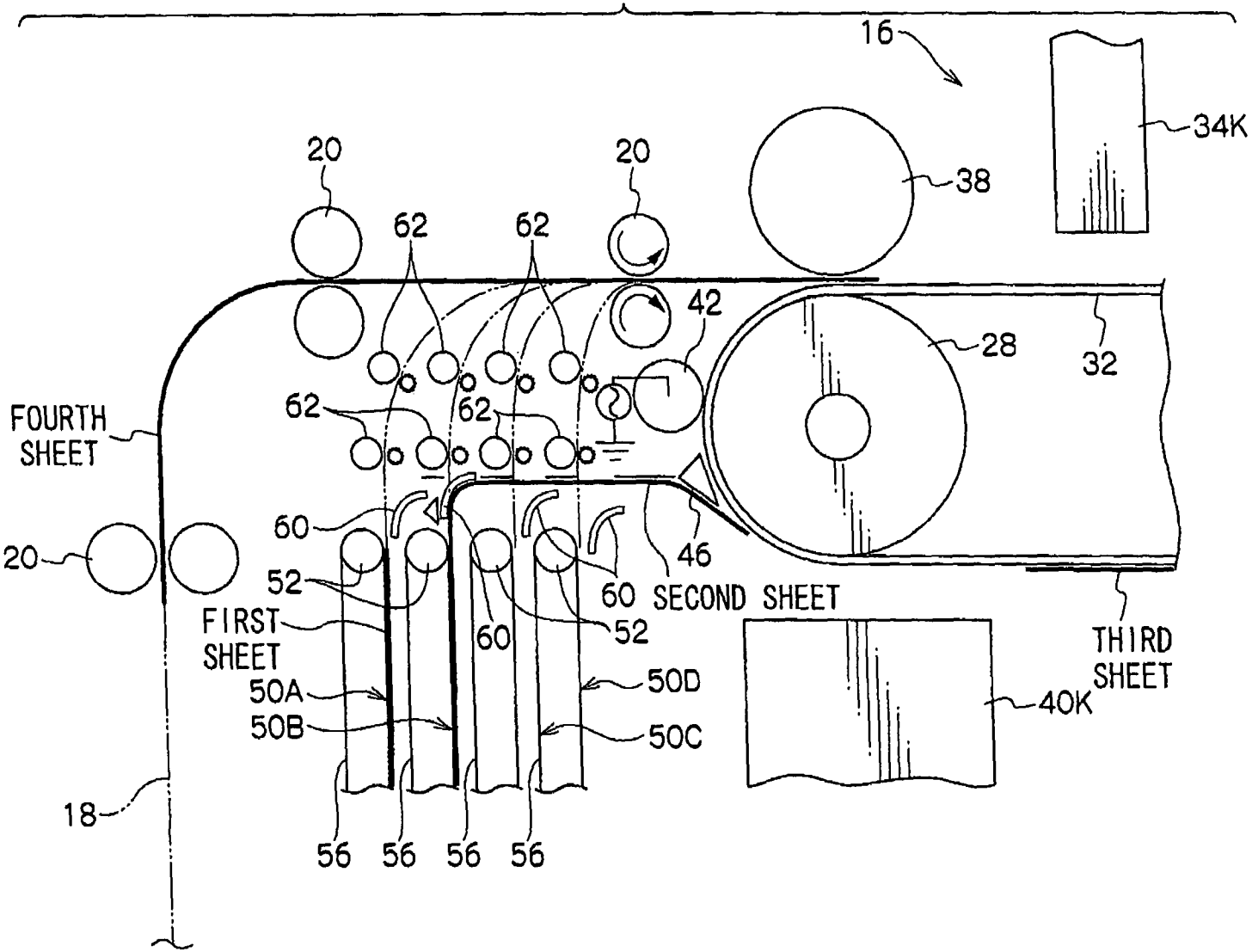
FIG. 4B shows the position of each sheet when a second sheet is delivered into the holding unit in the printing procedure according to the embodiment.

Then, as shown in FIG. 4B, the second sheet conveyed on the conveying belt 32 is sent to the second holding unit 50B. At this time, the surface printing (third-page printing) on the third sheet has been completed, and the third sheet is being conveyed on the conveying belt 32. The sheet feeding of the fourth sheet is started.

Figure 4C:
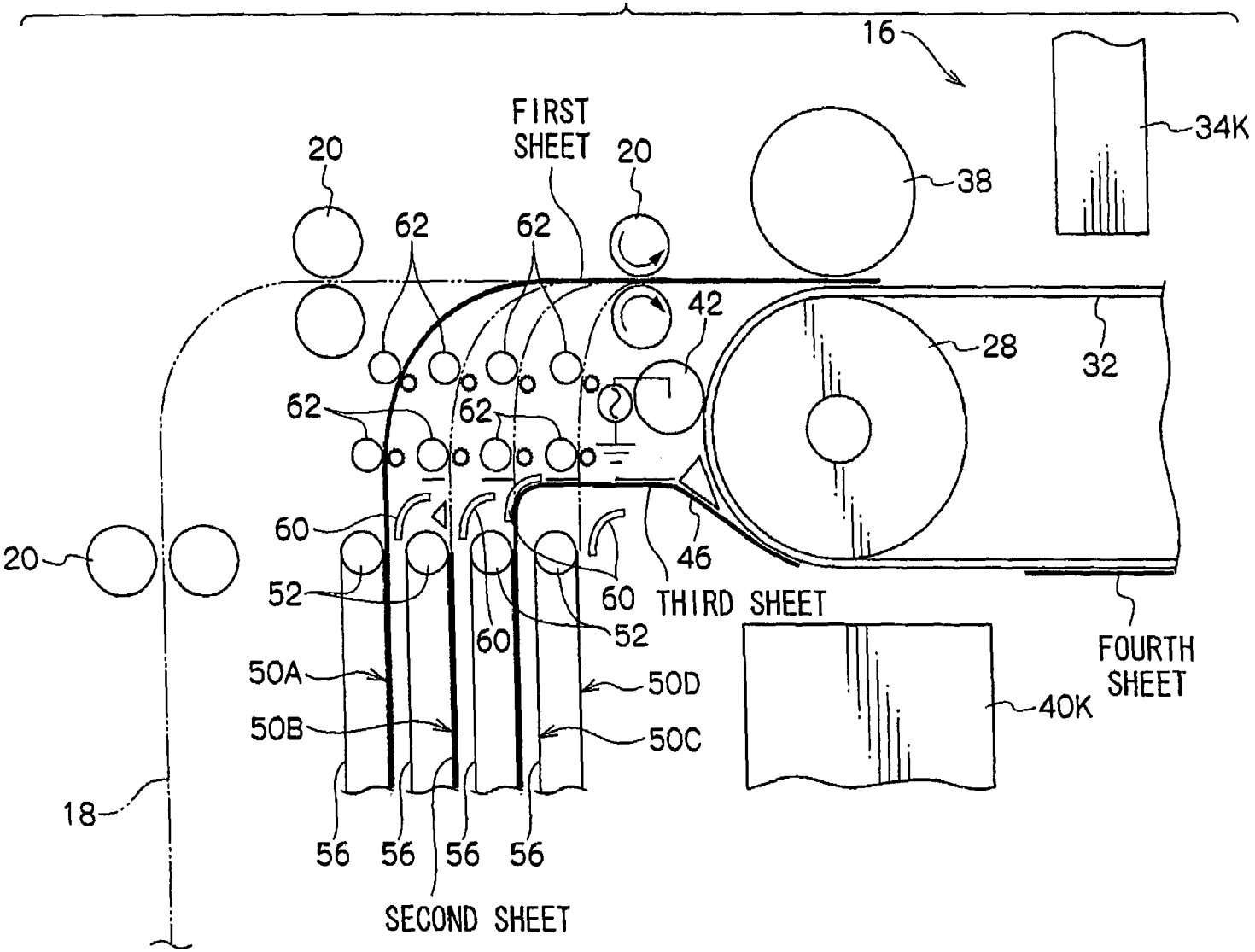
FIG. 4C shows the position of each sheet when a third sheet is delivered into the holding unit in the printing procedure according to the embodiment.

Then, as shown in FIG. 4C, the third sheet conveyed on the conveying belt 32 is sent to the third holding unit 50C. At this time, the surface printing (fourth-page printing) on the fourth sheet has been completed, and the fourth sheet is being conveyed on the conveying belt 32.

Figure 3:
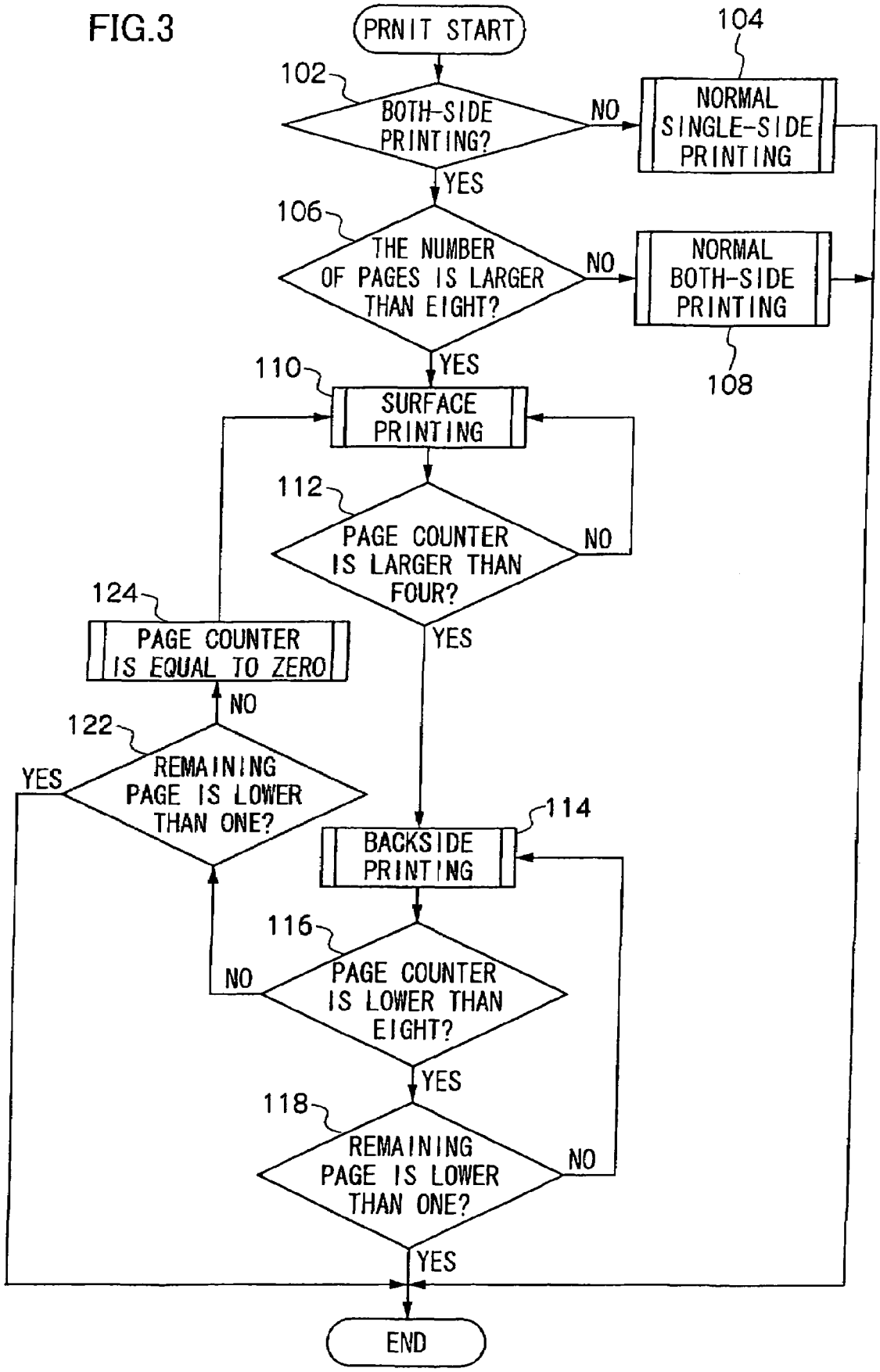
FIG. 3 is a flowchart showing a printing procedure according to the embodiment.

When the surface printing is performed on the fourth sheet, the printing procedure proceeds to Step 114 shown in FIG. 3 (flowchart), and the backside printing is performed. Specifically, the sheet feeding of first sheet held by the first holding unit 50A is started. Then, the backside printing is performed on the first sheet. At this time, the sheet feeding from the sheet tray is stopped.

Figure 4D:
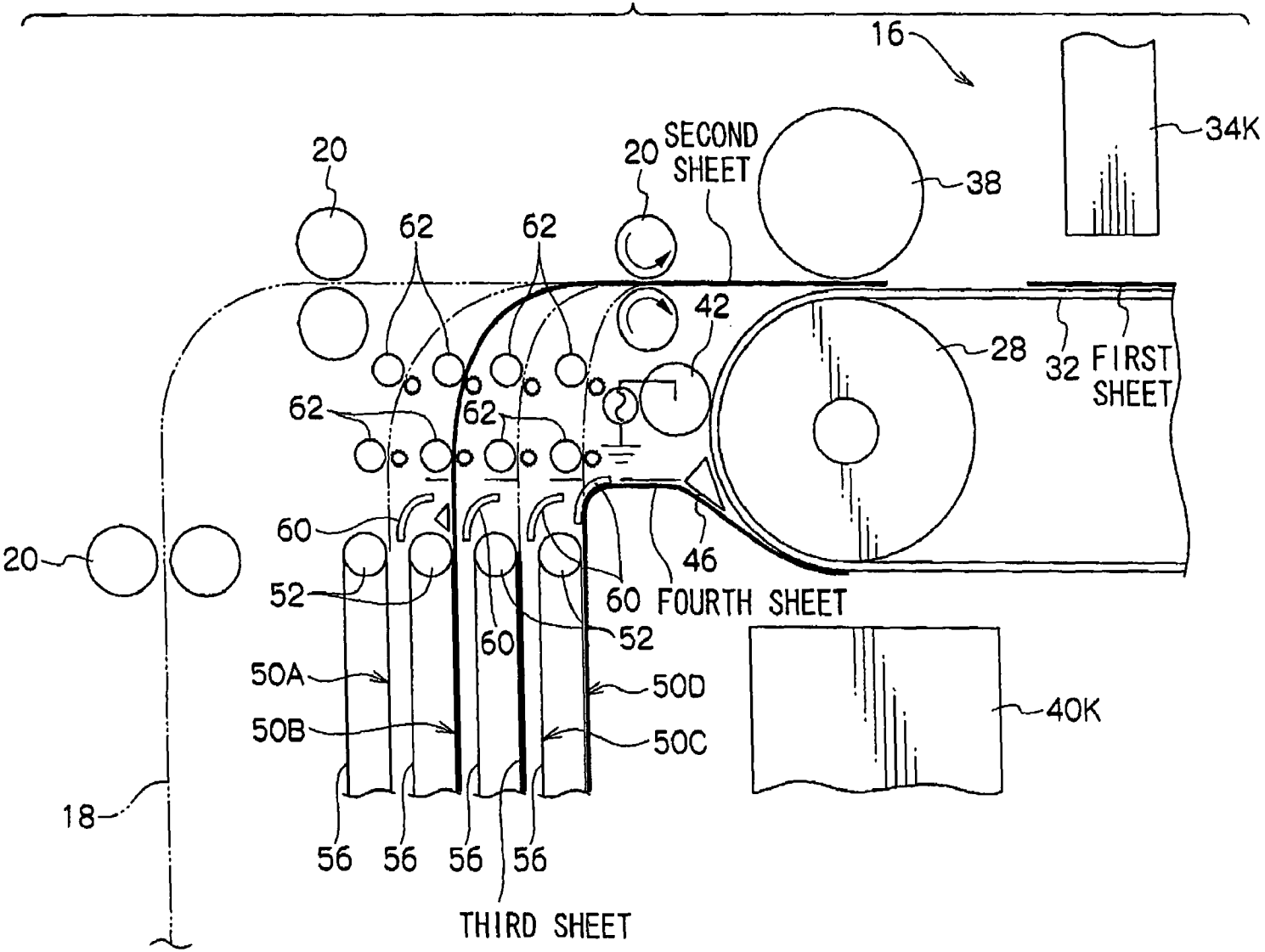
FIG. 4D shows the position of each sheet when a fourth sheet is delivered into the holding unit in the printing procedure according to the embodiment.

As shown in FIG. 4D, the first sheet fed from the first holding unit 50A is conveyed to the recording unit 16, and the backside printing is performed on the first sheet. Namely, the fifth-page printing is performed. At this time, the fourth sheet conveyed on the conveying belt 32 is sent to the fourth holding unit 50D. Further, the sheet feeding of the second sheet held by the second holding unit 50B is started.

Figure 4E:
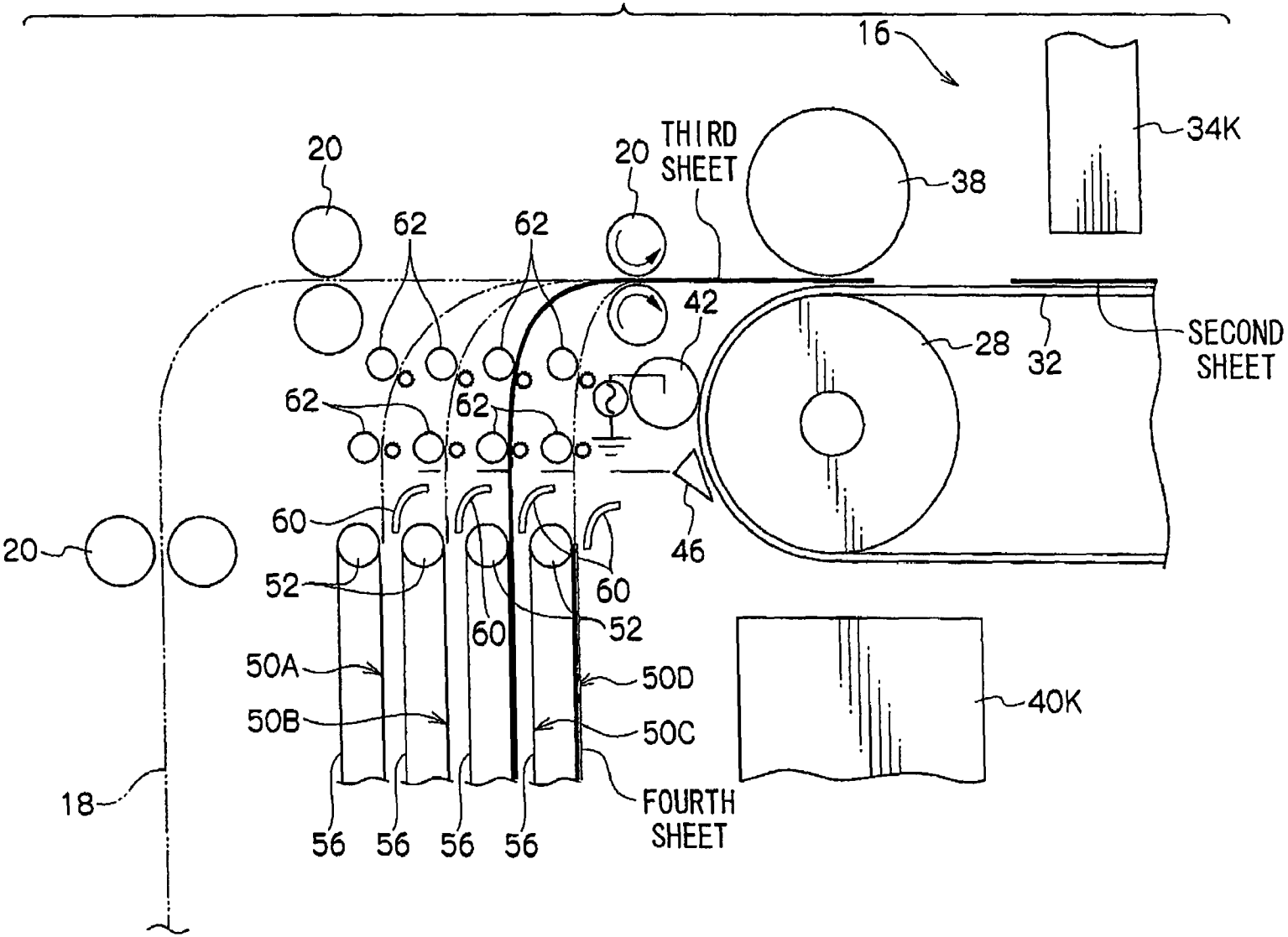
FIG. 4E shows the position of each sheet when the third sheet held is fed from the holding unit in the printing procedure according to the embodiment.

As shown in FIG. 4E, the second sheet held by the second holding unit 50B is conveyed to the recording unit 16, and the backside printing is performed on the second sheet. Namely, the sixth-page printing is performed. At this time, the first sheet is discharged. Further, the sheet feeding of the third sheet held by the third holding unit 50C is started.

Figure 4F:
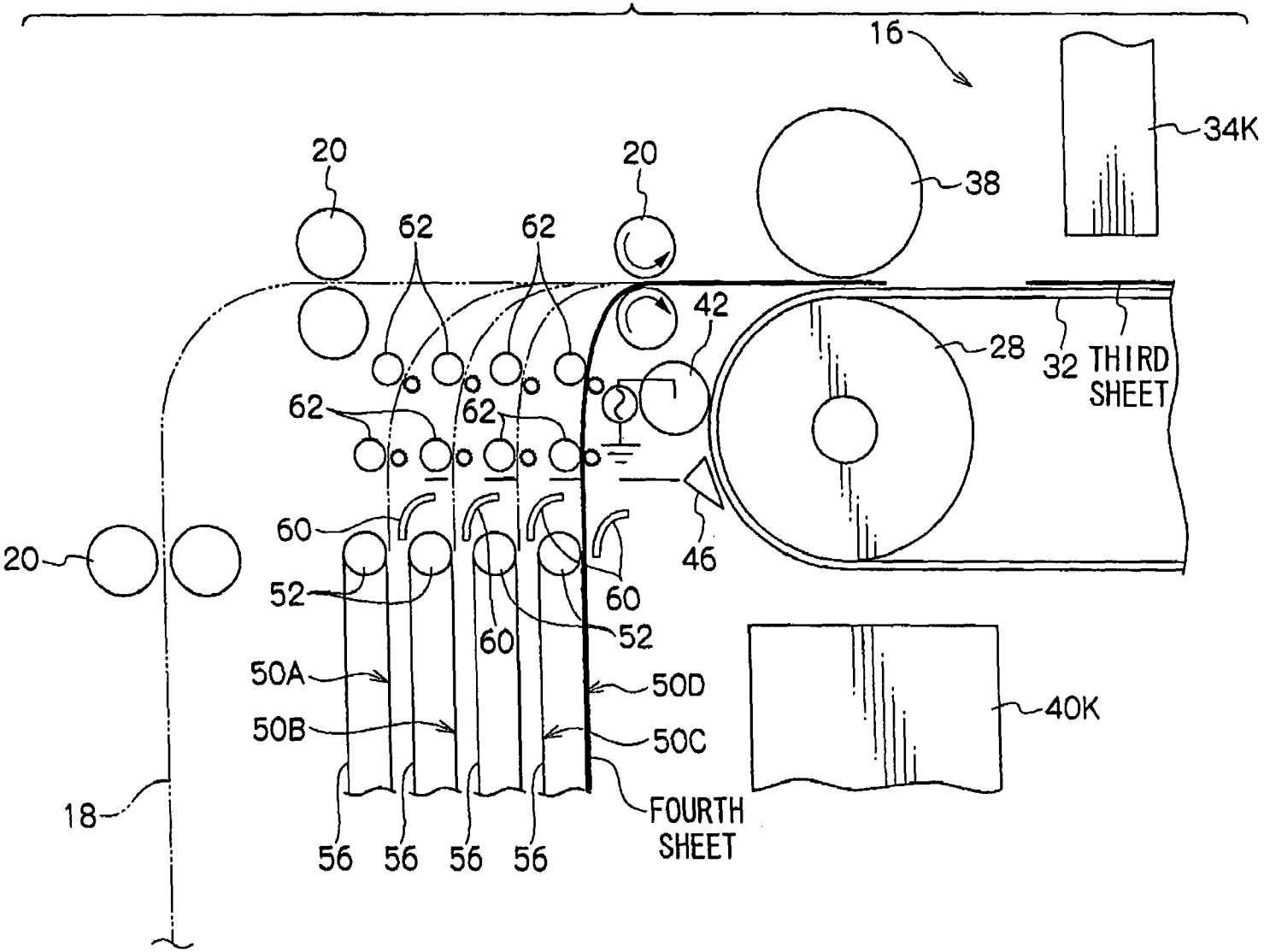
FIG. 4F shows the position of each sheet when the fourth sheet held is fed from the holding unit in the printing procedure according to the embodiment.

As shown in FIG. 4F, the third sheet held by the third holding unit 50C is conveyed to the recording unit 16, and the backside printing is performed on the third sheet. Namely, the seventh-page printing is performed. At this time, the second sheet is discharged. Further, the sheet feeding of the fourth sheet held by the fourth holding unit 50D is started.

Figure 4G:
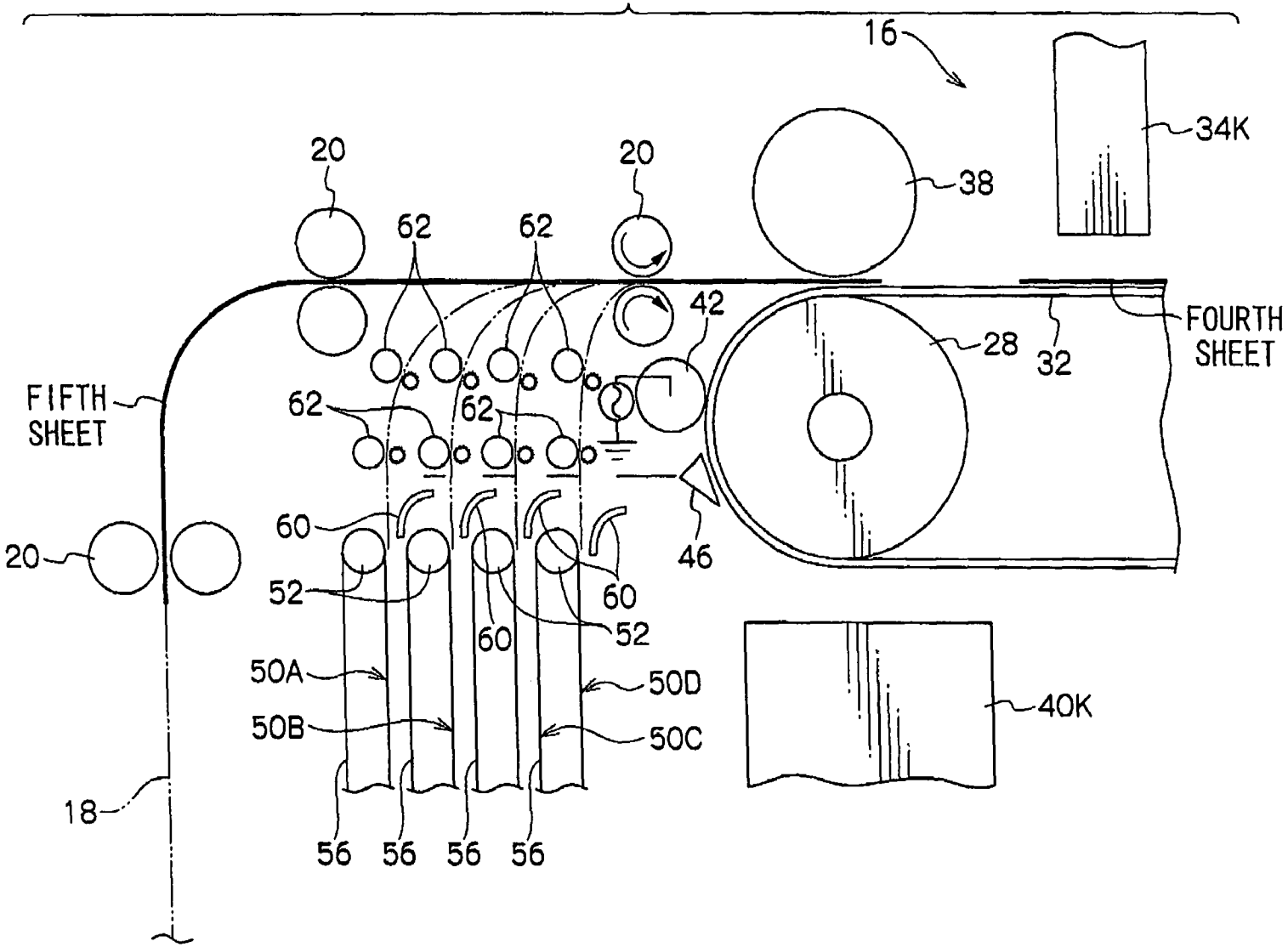
FIG. 4G shows the position of each sheet when backside printing is performed in the fourth sheet in the printing procedure according to the embodiment.

As shown in FIG. 4G, the fourth sheet held by the fourth holding unit 50D is conveyed to the recording unit 16, and the backside printing is performed to the fourth sheet. Namely, the eighth-page printing is performed. Since the double-sided printing is completed for the four sheets held by the first holding unit 50A to the fourth holding unit 50D respectively, the fifth sheet is fed from the sheet tray. Then, the surface printing is performed to the fifth sheet. Namely, the ninth-page printing is performed. Thus, the double-sided printing is performed by repeating the above processes.

Figure 5:
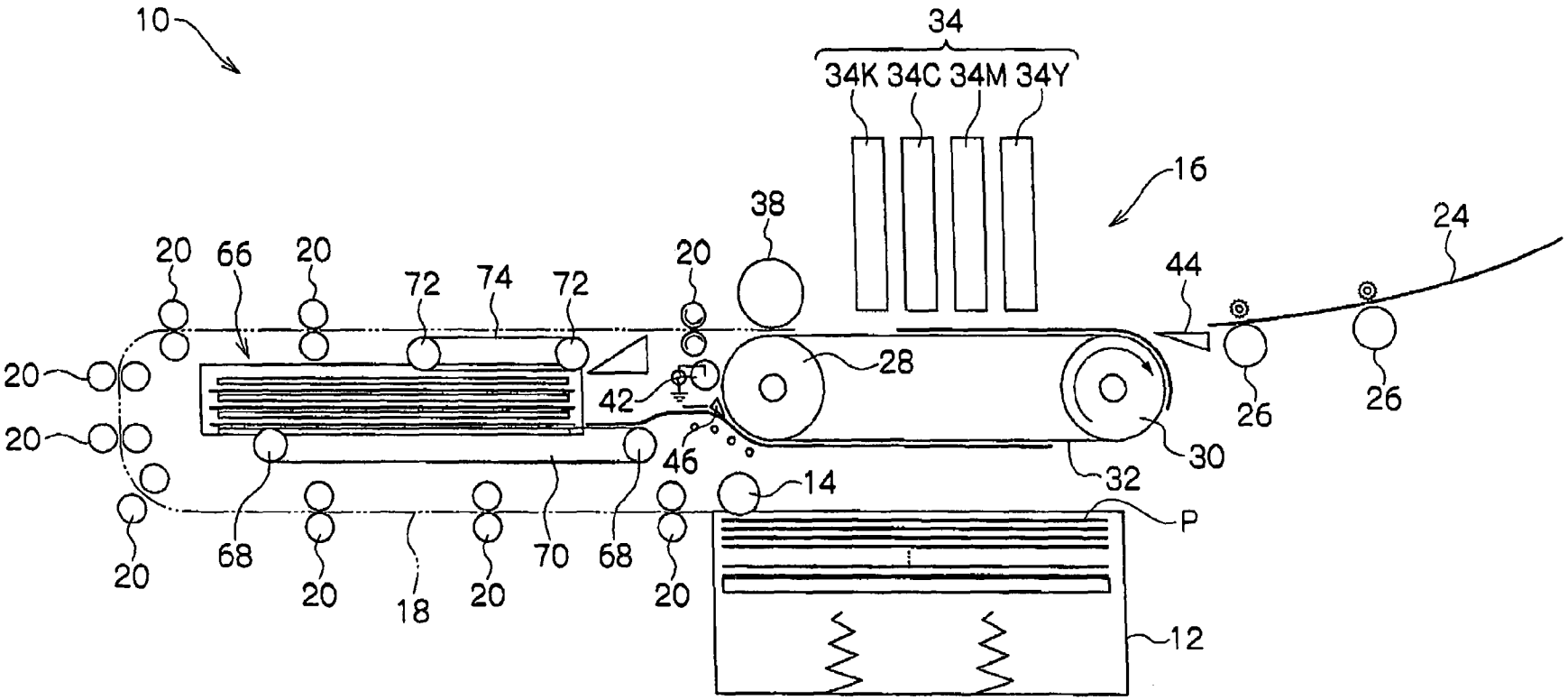
FIG. 5 is a side elevation showing a movement reversal unit according to the embodiment.
Figure 6:
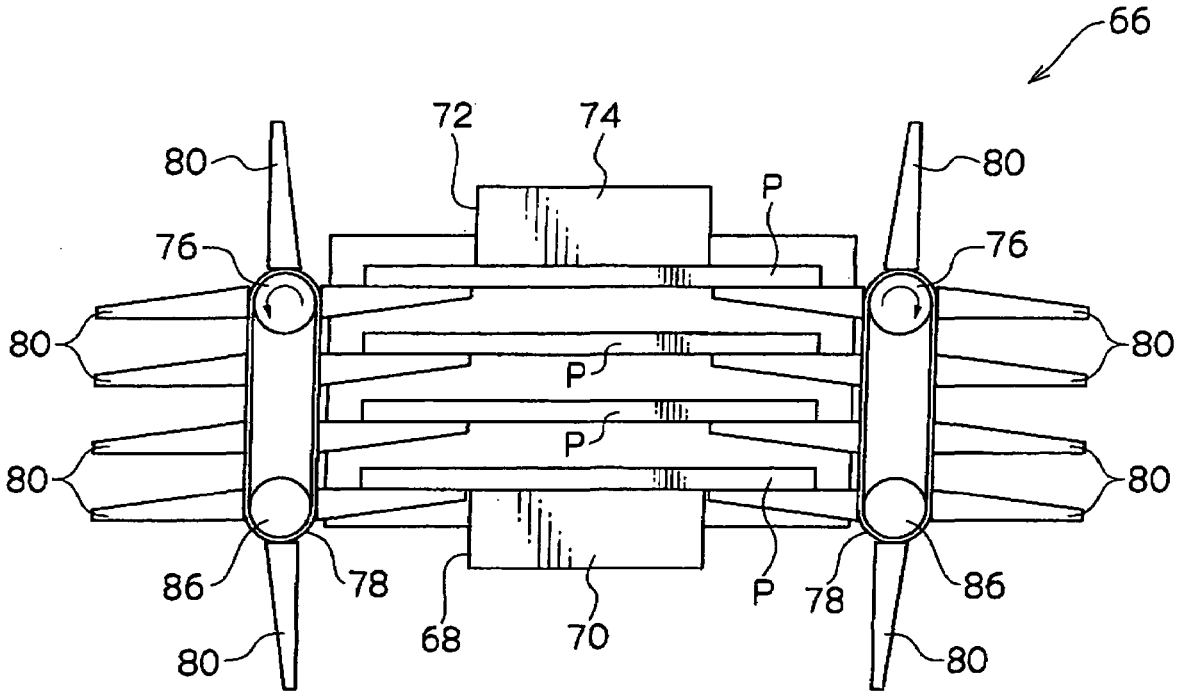
FIG. 6 is a front elevation showing the movement reversal unit according to the embodiment.
Figure 7:
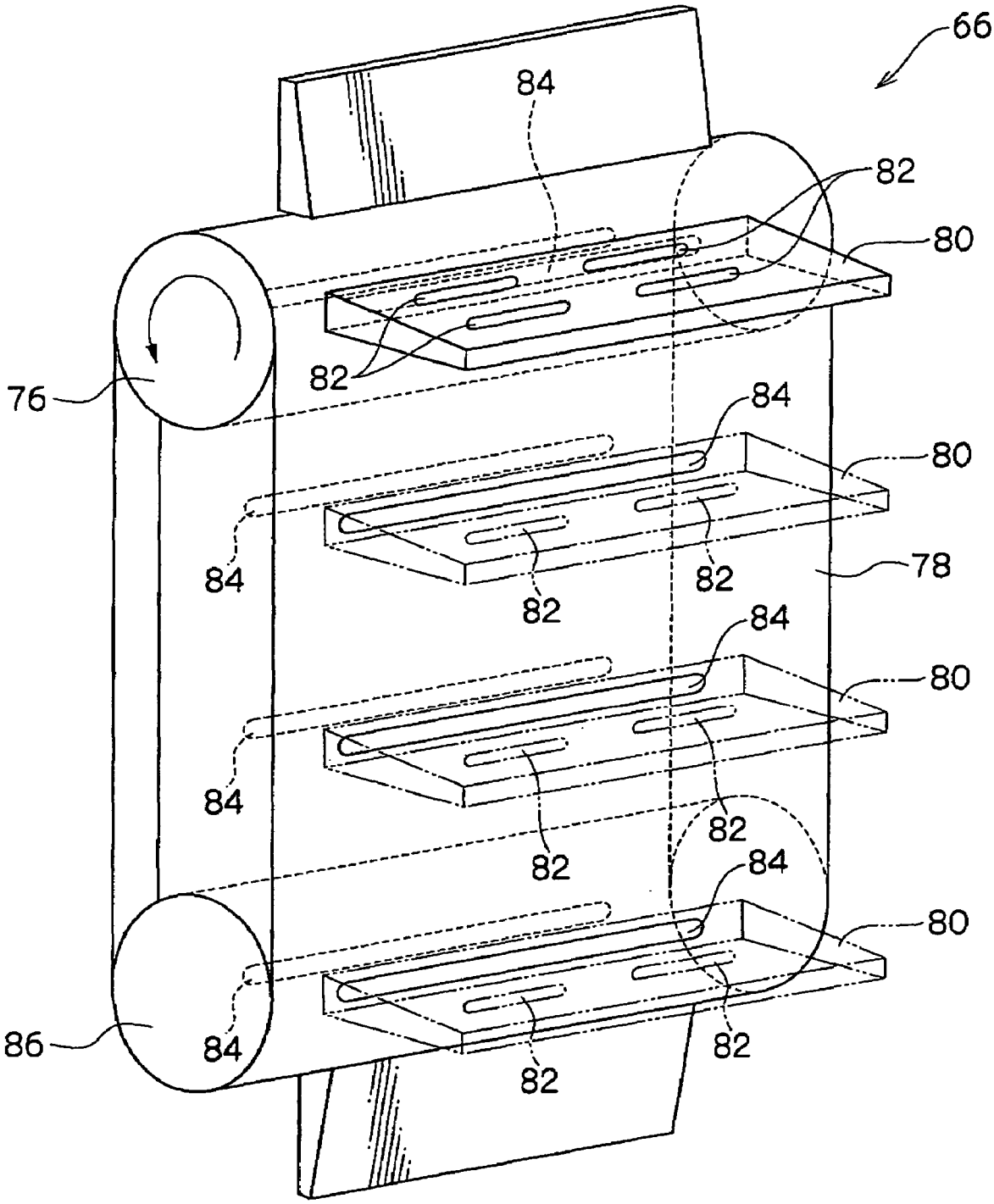
FIG. 7 is a perspective view showing the movement reversal unit according to the embodiment.

Referring to FIGS. 5 to 7, another example of the reversal unit 48 will be described below.

As shown in FIGS. 5 to 7, a movement reversal unit 66 including plural rotary type trays 80 can be used as the reversal unit. The rotary type tray 80 sucks and holds the recording medium to vertically rotate the recording medium.

The movement reversal unit 66 is arranged in a horizontal direction of the conveying belt 32, and the movement reversal unit 66 includes a take-in belt 70 which is entrained about a pair of lower rollers 68. The pair of lower rollers 68 is horizontally arranged to take the sheet P into the movement reversal unit 66. A sending belt 74 is arranged above the take-in belt 70. The sending belt 74 is entrained about a pair of upper rollers 72 which is horizontally arranged with a shorter spacing therebetween than that of the pair of lower rollers 68.

When the movement reversal unit 66 is viewed from a take-in port (from the right-side direction in FIG. 5), as shown in FIG. 6, two sets of drive roller 76 and driven roller 86 are horizontally arranged. The drive roller 76 is arranged in the upper portion and the driven roller 86 is arranged in the lower portion. Reversal belts 78 are entrained about the two sets of drive roller 76 and driven roller 86 respectively.

The plural trays 80 are vertically provided on the reversal belt 78. The tray 80 sucks both end portions of the lower surface of the sheet P taken in at a lower take-in position by the take-in belt 70, and the tray 80 rotates the sheet P to an upper sending position.

As shown in FIG. 7, plural suction holes 82 are provided on the upper surface of the tray 80, and the inside of the tray 80 is formed as a cavity. Sealing plates (not shown) are hung on end faces of the drive roller 76 and driven roller 86 to form a sealed space inside the reversal belt 78. The sealed space is communicated with a vacuum hole 84 provided in the reversal belt 78. Negative pressure is generated in the sealed space by a suction machine (not shown) connected to the inside of the reversal belt 78, which allows the sheet P to be sucked by the plural suction holes 82 through the vacuum hole 84.

The reversal belts 78 facing each other are inclined such that the upper portions of the reversal belts 78 extend outward. Therefore, the trays 80 arranged on the both sides of the sheet P are inclined such that the outside of the tray 80 is inclined downward, which allows the both end portions of the sheet P to be lifted from the lower side to apply tension to the sucked sheet P.

In the movement reversal unit 66 of the embodiment, the trays 80 are configured to hold the four sheets p. However, when at least two sheets P can be held by the movement reversal unit 66 which sequentially moves the sheet P, the switch back of the sheet P can smoothly be performed.

When the reversal belt passes through the drive roller 76 and the driven roller 86, the vacuum hole 84 is blocked by the drive roller 76 and the driven roller 86, which indirectly blocks the suction holes 82 communicated with the vacuum hole 84 to eliminate the negative pressure state. Therefore, the suction state of the sheet P is released at the take-in position and at the sending position.

It is also possible for the movement reversal unit 66 to be turned upside down and the take-in port to be set at the left side and arranged in the lower portion of the conveying belt 32.

The invention is not limited to the above embodiment, and various modes are possible.

In the embodiment, the movement reversal unit 66 has the configuration in which the sheet P is sucked by the suction machine. However, the invention is not limited to the embodiment. For example, it is also possible for the sheet to be electrostatically sucked.

As described above, the inkjet printer (recording apparatus) 10 according to the embodiment includes the recording unit 16, the conveying belt (conveying unit, conveying body) 32, and the reversal unit 48. The recording unit 16 ejects the ink onto the conveyed sheet (recording medium) P to record the image. The conveying belt 32 sequentially returns the sheet P on which the image recording has been performed toward the upstream side in the conveying direction. The reversal unit 48 is provided on the downstream side of the conveying belt 32 in the returning direction, and the reversal unit 48 includes the plural holding units 50. The holding unit 50 reverses the sheet P and sends the sheet P to the recording unit 16 while sucking and holding the non-recording surface of the sheet P returned by the conveying belt 32.

In the above configuration, the recording unit 16 ejects the ink onto the conveyed sheets P to record images, and the conveying belt 32 sequentially returns the sheets P on which the image recording has been performed toward the upstream side in the conveying direction not by reversing the sheets P but by sending the sheets P in order. The non-recording surfaces of the sheets P returned by the conveying belt 32 are sucked and held by the plural holding units 50 of the reversal unit 48 provided on the downstream side of the conveying belt 32 in the returning direction, and the sheets P are reversed and sent to the recording unit 16.

Thus, since the sheet P on which the image recording has been performed is reversed by the reversal unit 48 provided on the downstream side of the conveying belt 32 in the returning direction, the time from the image recording to the reversal is lengthened, and drying time for the ink on the sheet P can be secured after the image recording.

Since the reversal unit 48 includes the plural holding units 50, at the same time when one of the sheets P is reversed and sent to the recording unit 16 while sucked and held, the next returned sheet P can be sucked and held by another holding unit 50.

Therefore, even if there are plural sheets P on which the double-sided image recording is performed, the sheets P are smoothly reversed and sent to the recording unit 16, which allows the decrease in image recording speed to be suppressed to maintain high-speed image recording.

When one of the sheets P is sent to the recording unit again while the plural sheets P are sucked and held by the holding units 50, the waiting time can be secured for other sheets P while one of the sheets P is sent, which allows frying time for the ink on the sheet P to be secured.

Further, since the holding unit 50 sucks and holds the non-recording surface of the sheet P, the recording surface on which the image recording has been performed dries easily, and generation of curl and cockle can be suppressed in the sheet P.

When the holding unit 50 sends the sheet P to the recording unit 16, the sheet P is sent to the recording unit 16 through the conveying path 18.

Further, in the embodiment, the holding unit 50 includes the suction belt 56 which sucks and holds the sheet P. The holding unit 50 normally rotates the suction belt 56 to take in the sheet P returned by the conveying belt 32, and the holding unit 50 reversely rotates the suction belt 56 to send the sheet P to the recording unit 16.

In the above configuration, the suction belt 56 is normally rotated to take in the sheet P returned by the conveying belt 32, and the suction belt 56 is reversely rotated to send the sheet P to the recording unit 16.

Thus, the holding unit 50 is formed by the suction belt 56 which sucks and holds the sheet P, which allows the holding unit 50 to be formed in a compact size to reduce an installation space of the holding unit 50 in the recording apparatus.

In the embodiment, the holding units 50 are arranged in parallel with one another.

Even when the reversal unit 48 includes plural holding units 50, the installation space of the holding unit 50 can be reduced in the recording apparatus by arranging the holding units 50 in parallel with one another. In the layout of the holding units 50, it is possible for the holding units 50 to be vertically arranged in parallel with one another, and it is also possible for the holding units 50 to be horizontally arranged in parallel with one another. The arrangement of the holding units 50 may be determined in view of other components in the inkjet printer 10.

In the embodiment, the conveying belt 32 conveys the sheet P from the recording unit 16 to the reversal unit 48 while sucking the sheet P, and the number of holding units 50 in the reversal unit 48 is a number not lower than two times the number of sheets P which the conveying belt 32 can convey without overlapping the sheets P.

Therefore, when the double-sided recording is performed on the sheets P whose number is larger than that of holding units 50, the images can smoothly be recorded on both the surfaces and the backsides of the sheets P. Accordingly, even if the double-sided recording is performed on the sheets P whose number is larger than that of holding units 50, the decrease in total speed can be suppressed in the image recording, and high-speed image recording can be maintained.

In another example of the reversal unit 48 according to the embodiment, it is also possible for the movement reversal unit 66 to include the trays (holding units) 80. The trays 80 take in the sheets P returned by the conveying belt 32 at the take-in position, and the trays 80 are sequentially moved to the sending position to send the sheets P to the recording unit 16 at the sending position.

In the above configuration, the trays 80 take in the sheets P returned by the conveying belt 32 at the take-in position, and the trays 80 are sequentially moved to the sending position to send the sheets P to the recording unit 16 at the sending position. Therefore, since interference is not generated between the sheet P taken into the tray 80 and the sheet P sent to the recording unit 16, smooth reversal can be performed. Further, when the plural trays 80 for holding the sheets P are provided in the mechanism in which the trays 80 are sequentially moved, since the sheet P can smoothly be reversed, reduction in size of the reversal unit 48 can be realized.

The trays 80 are of a rotary type in which the sheet P is vertically rotated while sucked and held. It is also possible that the trays are configured such that the sheet P is taken in at the lower take-in position to rotate the sheet P upward and the sheet P is sent to the recording unit 16 at the upper sending position.

In the above configuration, the sheet P is taken into the lower tray 80 from the conveying belt 32 and the sheet P is reversed and sent from the upper tray 80 to the conveying belt 32. Therefore, it is not necessary to perform both normal rotation and reverse rotation of the drive unit, and the drive unit can be rotated in one direction, which simplifies the control.

Further, it is also possible for the trays 80 to be arranged on both sides of the sheet P and for tension to be applied to both end portions of the sheet P by lifting the sheet P from the lower side to suck and hold the sheet P.

In the above configuration, the tray 80 lifts both end portions of the sheet P from the lower side to suck and hold the sheet P, and tension is applied to the sheet P. Therefore, generation of curl and cockle can be suppressed in drying the sheet P.

Further, it is also possible for the tray 80 to be configured such that the sheet P is sucked and held by the suction holes 82, in which the negative pressure is generated, and the suction state of the sheet P is released by blocking the suction holes at the take-in position and the sending position.

In the above configuration, since the suction state is released at the take-in position and the sending position, the take-in and sending of the sheet P can smoothly be performed.

What is claimed is:

1. A recording apparatus comprising:

a cassette which stores a recording medium;

a recording unit which records an image by ejecting ink to the recording medium;

a sheet-feed conveying path which extends from a leading end portion adjacent the cassette to a distal end portion adjacent the recording unit;

an endless conveying unit downstream of said sheet-feed conveying path which returns the recording medium, on which the image is recorded by the recording unit, in order toward said distal end portion of said sheet-feed conveying path at an upstream side in a conveying direction; and a reversal unit adjacent said distal end portion of said sheet-feed conveying path which is provided at a downstream side of the conveying unit in a returning direction, the reversal unit including a plurality of holding units which respectively suck and hold a recording medium that has been returned by the conveying unit, reverse the recording medium, and send the recording medium to the sheet-feed conveying path at a position between the cassette and the recording unit;

wherein the conveying unit cyclically travels between the recording unit and the reversal unit and conveying the recording medium from the recording unit to the reversal unit.

2. The recording apparatus of claim 1, wherein the holding unit sucks and holds a non-recording surface of the recording medium.

3. The recording apparatus of claim 2, wherein the plurality of holding units are arranged in parallel with one another.

4. The recording apparatus of claim 3, wherein the conveying unit is a conveying body which sucks the recording medium to convey the recording medium from the recording unit to the reversal unit, and the number of holding units of the reversal unit is al least two times the number of sheets which the conveying body can convey without overlapping the recording medium.

5. The recording apparatus of claim 2, wherein the conveying unit is a conveying body which sucks the recording medium to convey the recording medium from the recording unit to the reversal unit, and the number of holding units of the reversal unit is at least two times the number of sheets which the conveying body can convey without overlapping the recording mediums.

6. The recording apparatus of claim 1, wherein the holding unit is a suction belt which sucks and holds a non-recording surface of the recording medium, the holding unit is normally rotated to take in the recording medium returned by the conveying unit, and the holding unit is reversely rotated to send the recording medium to the sheet-feed conveying path toward the recording unit.

7. The recording apparatus of claim 6, wherein the plurality of holding units are arranged in parallel with one another.

8. The recording apparatus of claim 7, wherein the conveying unit is a conveying belt which sucks the recording medium to covey the recording medium from the recording unit to the reversal unit, and the number of holding units of the reversal unit is al least two times the number of sheets which the conveying body can convey without overlapping the recording medium.

9. The recording apparatus of claim 6, wherein the conveying unit is a conveying body which sucks the recording medium to convey the recording medium from the recording unit to the reversal unit, and the number of holding units of the reversal unit is at least two times the number of sheets which the conveying body can convey without overlapping the recording mediums.

10. The recording apparatus of claim 1, wherein the plurality of holding units are arranged in parallel with one another.

11. The recording apparatus of claim 10, wherein the conveying unit is a conveying belt which sucks the recording medium to convey the recording medium from the recording unit to the reversal unit, and the number of holding units of the reversal unit is at least two times the number of sheets which the conveying body can convey without overlapping the recording mediums.

12. The recording apparatus of claim 1, wherein the conveying unit is a conveying body which sucks the recording medium to convey the recording medium from the recording unit to the reversal unit, and the number of holding units of the reversal unit is at least two times the number of sheets which the conveying body can convey without overlapping the recording mediums.

13. The recording apparatus of claim 1, wherein the plurality of holding units respectively take in recording mediums returned by the conveying unit at a take-in position, the plurality of holding units sequentially move the recording mediums to a sending position, and the plurality of holding units send the recording mediums to the recording unit from the sending position.

14. The recording apparatus of claim 1, wherein each of the plurality of holding units is a rotary type tray which sucks the recording medium onto an upper surface thereof and rotate while holding the recording medium to convey the recording medium in a vertical direction, the rotary type tray takes in the recording medium at the take-in position located in a lower position, and the rotary type tray rotates the recording medium to send the recording medium to the recording unit from the sending position located at an upper position.

15. The recording apparatus of claim 14, wherein the trays are arranged on both sides of the recording medium, and the trays suck and hold the recording medium by lifting both end portions of the recording medium from a lower side, which applies tension to the recording medium.

16. The recording apparatus of claim 15, wherein the tray comprises a suction hole in which negative pressure is generated in an upper surface so that the recording medium is suctioned and held onto the upper surface, and the suction state of the recording medium is released at the take-in position and at the sending position.

17. The recording apparatus of claim 15, wherein the holding unit electrostatically sucks and holds a sheet.

18. The recording apparatus of claim 14, wherein the tray comprises a suction hole in which negative pressure is generated on an upper surface so that the recording medium is suctioned and held onto the upper surface, and the suction state of the recording medium is released at the take-in position and at the sending position.

19. The recording apparatus of claim 14, wherein the holding unit electrostatically sucks and holds a sheet.

20. The recording apparatus of claim 1, wherein the plurality of holding units are vertically arranged in parallel with one another.

21. The recording apparatus of claim 1, wherein the plurality of holding units are horizontally arranged in parallel with one another.

22. The recording apparatus of claim 1, wherein each of the holding units sucks and holds only one recording medium at a time.

* * * * *